United States Patent [19]

Ettore

[11] 4,155,401

[45] May 22, 1979

[54] DEVICE FOR THE EXTRACTION OF MOLDING SHELLS

[76] Inventor: Gerosa Ettore, via Pace di Lodi N°1-20075, Lodi, Italy

[21] Appl. No.: 464,509

[22] Filed: Apr. 26, 1974

[51] Int. Cl.[2] ..... B22C 17/08

[52] U.S. Cl. ..... 164/213; 164/404

[58] Field of Search ..... 164/44, 180, 181, 183, 164/185, 214, 215, 401-404, 165, 213, 227, 361, 409, 166, 375, 205, 224

[56] References Cited

U.S. PATENT DOCUMENTS

| | | | |
|---|---|---|---|
| 1,074,518 | 9/1913 | Mott | 164/375 |
| 1,456,318 | 5/1923 | Lewis | 164/402 |
| 1,948,799 | 2/1934 | Oyster | 164/409 X |
| 2,225,292 | 12/1940 | Andrews | 164/404 |
| 2,623,252 | 12/1952 | Miller | 164/409 X |
| 2,742,683 | 4/1956 | Knipp et al. | 164/409 |
| 2,962,774 | 12/1960 | Hoekstra | 164/165 |
| 3,103,044 | 9/1963 | Joly | 164/404 |
| 3,508,598 | 4/1970 | York | 164/166 X |
| 3,589,431 | 6/1971 | Fellows | 164/37 X |

*Primary Examiner*—Richard B. Lazarus
*Assistant Examiner*—John S. Brown
*Attorney, Agent, or Firm*—Hubbell, Cohen, Stiefel & Gross

[57] ABSTRACT

An automatic machine and process for removing semi-shells from a foundry moulding machine for overturning said shells and for disposing them in a work area remote from the foundry moulding machine. Apparatus includes a multi-armed fork mounted for pivotal movement about a horizontal axis, the fork carrying flanged shell grasping members and piston-cylinder means for moving the grasping members of the shell into grasping relationship, the fork pivoting after the shells have been grasped to move the shells to an intermediate position in which they are automatically overturned by virtue of the pivotal movement and then horizontally moving the overturned shells from the intermediate position to a position more remote from the foundry machine wherein work can be performed thereon in comfort.

9 Claims, 10 Drawing Figures

DEVICE FOR THE EXTRACTION OF MOLDING SHELLS

BACKGROUND OF THE INVENTION

1. Field of the Invention

This invention relates to the extraction of (semi) shells from forming machines employed in the shell moulding process. More particularly the invention concerns a method and the relative equipment for the rapid and safe extraction of the hot (semi-) shells and for their overturning through 180 degrees relative to the position of lift-off from the forming machine.

2. The Prior Art

It is well-known that for the preparation of shell castings it is necessary to prepare the shells from a sand-resin paste which is spread on the mould end heated by means of methane jets; generally the forming machine produces two semi-shells or indeed two pairs of semi-shells at a time.

Extraction of the semi-shells has always involved many problems; it is indeed true that the forming machines are furnished with bars which, as soon as the moulding has been carried out, lift the semi-shells from their place facilitating their extraction, but it is also true that the workman who grips the hot semi-shells with gloves is struck by the intense heat from the jets and the shells themselves and has to work in conditions that are uncomfortable, besides being dangerous. To avoid these drawbacks use has been made of extracting machines consisting essentially of extracting forks with a forward and backward movement which slip beneath the semi-shells the moment that the extracting bars raise them from their forming position. When these bars descend the semi-shells perch on the forks which execute a backward movement withdrawing the semi-shells from their place by about 1 m. On completion of this movement the forks can generally also turn through a vertical axis of 45 or 90 degrees carrying the semi-shells into a position which is off-set from the above-mentioned rotation angle, relative to the axis passing through the middle-line of the forming machine and the extracting machine. Here the workman takes hold of the semi-shells in order to separate them from one another, overturn them, possibly insert the core and put them into the machine which glues them in pairs. Conventional shell-extracting machines present various disadvantages: they displace the shells little, which means that even in the withdrawn position (generally a matter of 1 meter) and possibly rotated (45 or 90 degrees) the workman is still always exposed to a strong heat (or to the danger of bursts of flame) from the forming machine; the semi-shells are still too hot and call for considerable effort in their lifting but above all in their inverting through 180 degrees, i.e. turning them upside down.

In effect while it is true that the forks have moved them from the forming machine, they have left them in the original position (base upwards) which they had in the moulding machine. Lastly the conventional machines are bulky in themselves and moreover call for much space because the workman besides moving the semi-shells must also turn them before placing them on the bench for the core-assembly and glueing operations.

SUMMARY OF THE INVENTION

The purpose of this invention is a process by which transfer of semi-shells from the moulder to the glueing-machine can be effected with fewer operations and under conditions of maximum safety, at high speed and with minimum encumbrance (overall dimensions). The new process is characterized by the fact that the semi-shells, in their moulding position, are grasped on the lower side face, are overturned (pivoted) essentially through 180 degrees around a horizontal axis, are deposited in an overturned position relative to that of moulding, on a practically horizontal plane at a distance from the said hot zone equal to the diameter of the semi-circumference described in a vertical plane by the points of the shells in the course of their overturning, and that finally the shells withdrawn from and overturned in respect to the moulding position are pushed to the working position by means of a simple horizontal movement.

According to one advantageous feature of the invention, the lifting on the lateral face of the semi-shells and their overturning is effected by a complex single unit which carries out the operations of approach to and withdrawal from the hot area at variable speeds. The invention also includes an apparatus for the execution of the process in question. The machine according to the invention is characterized essentially in that it consists of:

(a) means for taking and griping the semi-shells which means engage the lower lateral faces and the bases of said semi-shells, said means being capable of effecting movements of translation in a direction essentially at right angles to the said faces;

(b) a complex means of transferring semi-shells from a hot area to an intermediate position far from it, said means being exclusively animated by a rotating movement around a horizontal axis, and (c) means to impart a basically horizontal translation to the semi-shells when in a overturned position in relation to that of lift-off from the hot area, to transfer them to the working area.

In a preferred embodiment the said grasping mechanism (a) consists of flasks (stirrups) having a portion in the form of a seat to be slipped under the semi-shells, and a portion in the form of a back-rest to bear against the side-walls of the said semi-shells, the contact or lack of contact between the flasks and the semi-shells being determined by the movement of pistons connected to pneumatic cylinders. According to an other advantageous feature of the invention the means of transfer (b) is a pivoting fork consisting of two lateral arms and a central expansion to which is connected an oscillating frame which carries the above-mentioned cylinders for taking the semi-shells.

According to another preferred and advantagous feature of the invention the means (c) of transfer of the capsized shells from the intermediate position to the working position consists of a simple thrust trolley which imparts a mainly horizontal movement to the semi-shells.

The machine in accordance with the invention is further characterized by a circuit with pneumatic means for activation and control of the grasping cylinders and of the transfer cylinder for the thrust trolley; an oleodynamic circuit for the activation and control of the transfer overturning fork, and a series of means for the synchronisation of the said oleodynamic and pneumatic organs.

There now follows a detailed description of the invention with reference to the attached drawings in which appears a preferred form of realisation but which is not at all limitative.

Figure 1:
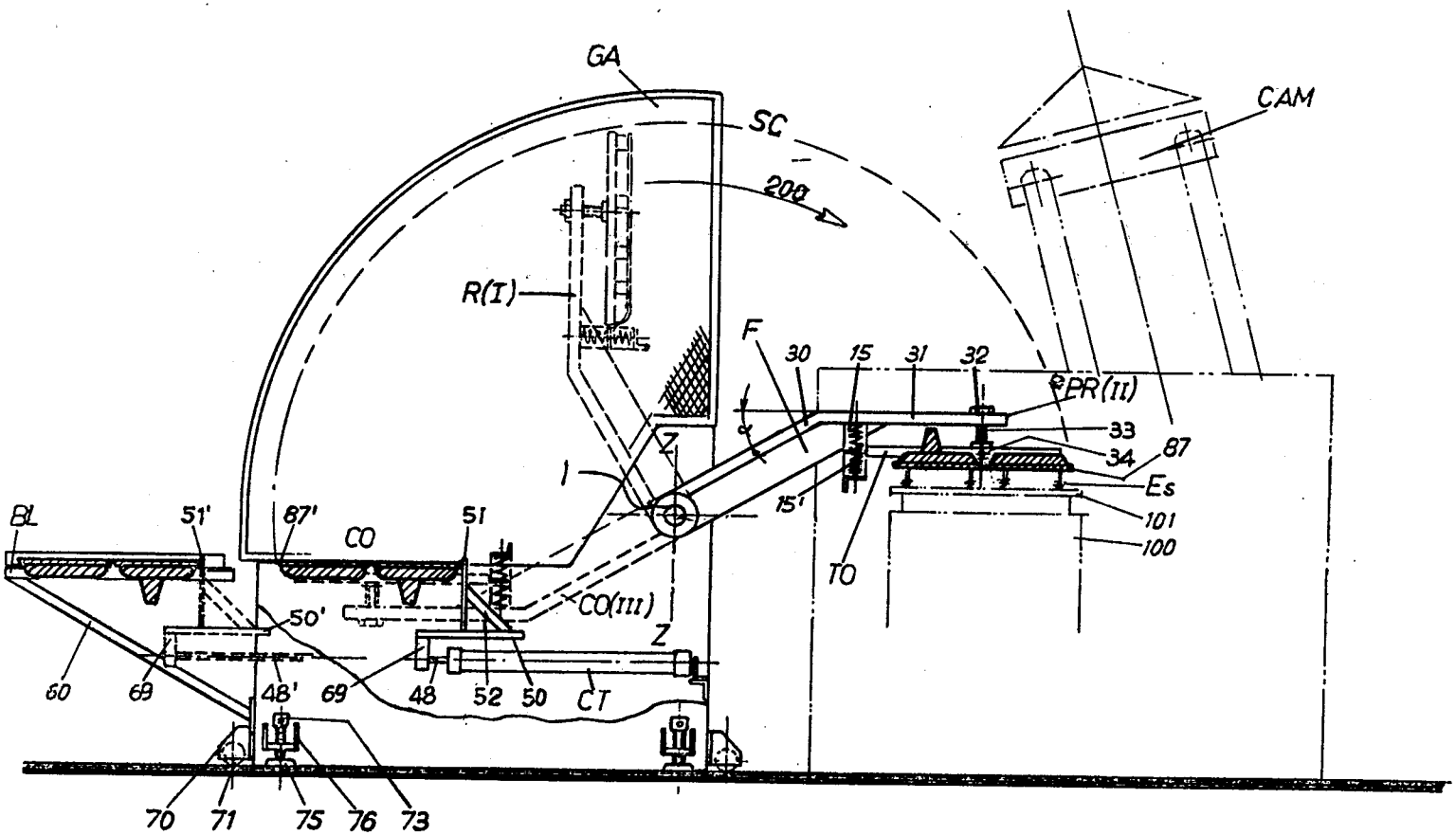
FIG. 1 is a partially schematic side view, partially in section and partially in plan at right angles to the horizontal axis of rotation of the oscillating fork.

In the figures, particularly 1 and 2, F indicates the pivoting fork or arm unit of the machine in accordance with the invention. Fork F rotates about a shaft 1 which defines a horizontal axis 1'. In a preferred embodiment (FIG. 2) the arm unit F consists of two lateral end arms B1 and B2 mounted respectively on the hubs M1 and M2 of the shaft 1, and of a central extension arm B3 (parallel and preferably equidistant from B1 and B2) which is mounted on the transverse member T extending between and stiffening arms B1 and B2. Fixed to the respective free ends E1, E2, and E3 of arms B1, B2 and B3 are lateral grasping members for the semi-shells G1 and G2 formed in the moulding machine 100. Each arm B1 and B2 is formed of a first part 30 and of a second part 31; the axis of part 30 forms an angle $\alpha$ with the axis of part 31. The shell lateral grasping member consists of an oscillating frame TO (FIG. 1) which is fixed to the ends E1, E2, and E3 of parts 31 of each arm by means of a threaded pivot 33 fixed to parts 31 by means of a nut 32 and to TO by means of a pivot 34. The frame TO oscillates around the pivots 34 thanks to the use of opposed pairs of springs 15 and 15'. From FIG. 3 it appears that the pairs of opposed springs are two, that is 15 and 15' and 16–16', each pair being preferably at the center of the area comprised by arms B1 and B3 and arms respectively B3 and B2. The oscillating frame TO is adjustable in height thanks to the threads of the pivot heads 33, 33' and 33" which bear at 34 on the said frame TO. The frame TO comprises three members TO1, TO2 and TO3 respectively underlying arms B1, B3 and B2. The internal ends of these three frame members are connected by a cross member TO'.

The frame member TO1 carries four cylinders C1, C2, C3 and C4. Similarly the frame member TO3 carries four cylinders C5, C6, C7 and C8. The central frame member TO2 on the other hand carries eight cylinders of which four C'1, C'2, C'3, and C'4 collaborate with the cylinders aligned with them C1, C2, C3, and C4 to grasp or grip the shell G1. Still with reference to the central element TO2, on it are fixed the other four cylinders C'5, C'6, C'7 and C'8 which work with the cylinders from C5 to C8 aligned with them to grasp shell G2. Therefore on the said central part TO2 are arranged eight cylinders of which those from C'1 to C'4 are aligned on an axis parallel and external to the lateral sides of the semi-shells while those from C'5 to C'8 are aligned on another axis, which is more offset towards G2 relative to the axis of the cylinders C'1–C'4 which is offset towards G1. This arrangement of the eight cylinders on the central part TO2 has many advantages especially as regards the compressed air supply system. For example in FIG. 4 can be seen also the tube 41 which connects the four cylinders C'1–C'2–C'3–C'4, the tube 42 which connects the four cylinders C'5–C'6–C'7–C'8 and the tube 43 which connects all eight cylinders.

Figure 4:
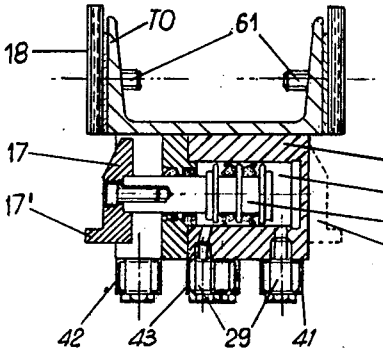
FIG. 4 is the schematic section with a plan having as trace the line Y—Y of FIG. 3.
Figure 5:
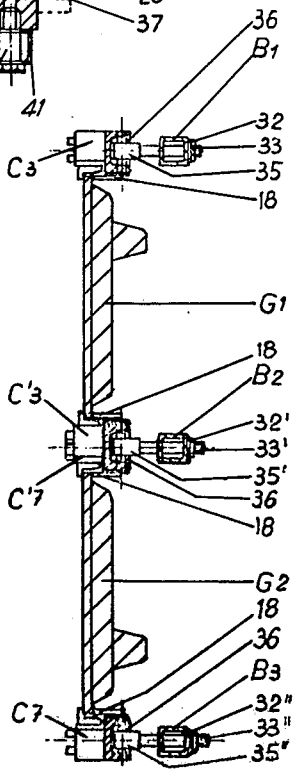
FIG. 5 is a schematic section of FIG. 3 with a plan the line X—X.
Figure 6:
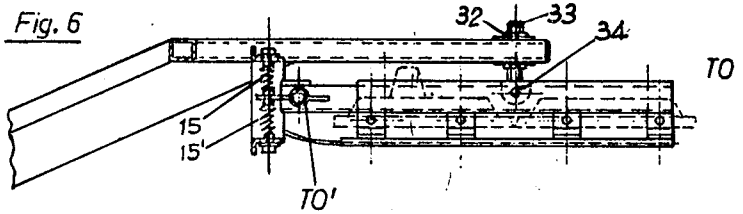
FIG. 6 is a side view of the part of the machine represented in the said FIG. 3.
Figure 3:
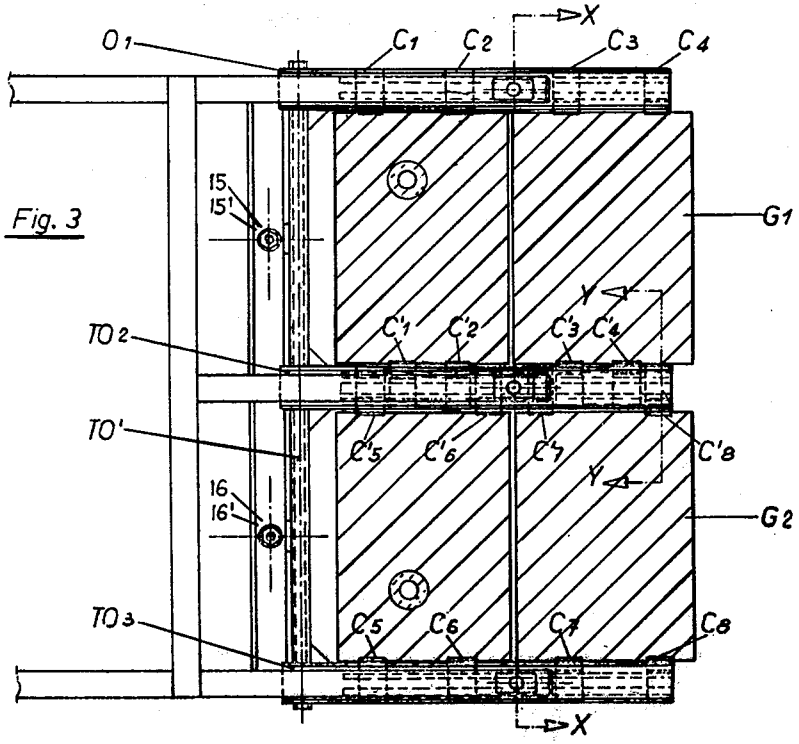
FIG. 3 is a plan view like FIG. 2, which shows however on an enlarged scale the grasping mechanism and their disposition on the oscillating frame fixed to the pivoting arms.

FIGS. 4 and 5 are two sections taken from FIG. 3 with plans along respectively Y—Y and X—X. In FIG. 4 it can thus be seen how, to the oscillating frame TO, are fixed respectively guide 18 having a series of small slots by means of which its position can be regulated with screws 61 to take account of the different thicknesses of shells of different series, and the body 12 of cylinder C'5. In this last unit is included chamber 19 for the piston unit 20 to the head of which is fixed a bar 17 furnished with a protruding stem 17'. The bar 17 indicated by a broken line belongs obviously to the next cylinder C'1. To the chamber 19 of each cylinder (in the case in question of cylinder C'5) are connected two heads 29 on which are fixed two compressed air tubes to control the movements of piston 20 and then the insertion of feet 17' under the shells to be removed as well as the release of these same feet at the moment of delivery of the shell. In fact, each bar can be thought of as consisting of a seat area 17' on which the base of the semi-shell is supported at the moment of return of the extractors Es, and of a backrest area 37 which adheres to the side faces of the said semi-shells without damaging them.

In FIG. 5 can be seen in fact the semi-shell G1 grasped by the bars 17' of the cylinders C3 on one side and 17" of C'3 on the other while G2 is grasped by the bars linked to the cylinders C'7 on one side and C7 on the other.

In FIG. 5, there are shown three pivots, 33, 33' and 33", which support the oscillating frame TO. The pivots are secured to the frame by means of fulcrums 35, 35' and 35" which pass through washers 36, 36' and 36". Also shown in FIG. 5 are three threaded nuts 32, 32' and 32" which fix respectively pivots 33, 33' and 33" to the arms B1, B3 and B2.

Going back now to the FIG. 1, CAM here indicates the cone of the shell-moulding machine, with 100 and 101 as the part of the said machine in which the shells are actually formed and with Es as the extractors thanks to which the formed shells are extracted from their place of formation. The characteristics of the forming machine do not form part of the invention in question, which therefore has the extra advantage of being capable of application to any kind of forming machine. The arm unit F according to the invention can assume the three basic positions of FIG. 1:

Ia position: the arm F is in the rest position R(I), that is in an almost vertical position inside the protection cage GA;

IIa position: going from the said position of rest R(I), with a rotation of about 90 degrees clockwise, the arm F arrives in the position to take the shells, indicated by PR(II) and by continuous line for the parts 30 and 31 of arm unit F; in this position the part 31 takes on a position basically horizontal and parallel to the plane of the shells supported by the raised extractors Es. Thus the oscillating frame TO comes to be aligned with the lower sides of the semi-shells G1 and G2, whereby moving inwards feet 17' of said flasks bars 17 linked to the pistons 20 of the grasping cylinders 19, the seat parts 17' of the said flasks bars will be able to take the shells comfortably penetrating with their feet (or parts of the seat) under the lower side of the shells ((see particularly FIG. 5) while the back parts 17 fit against the side faces of the semi-shells holding them firmly in the grasping position without any danger of damage.

Figure 2:
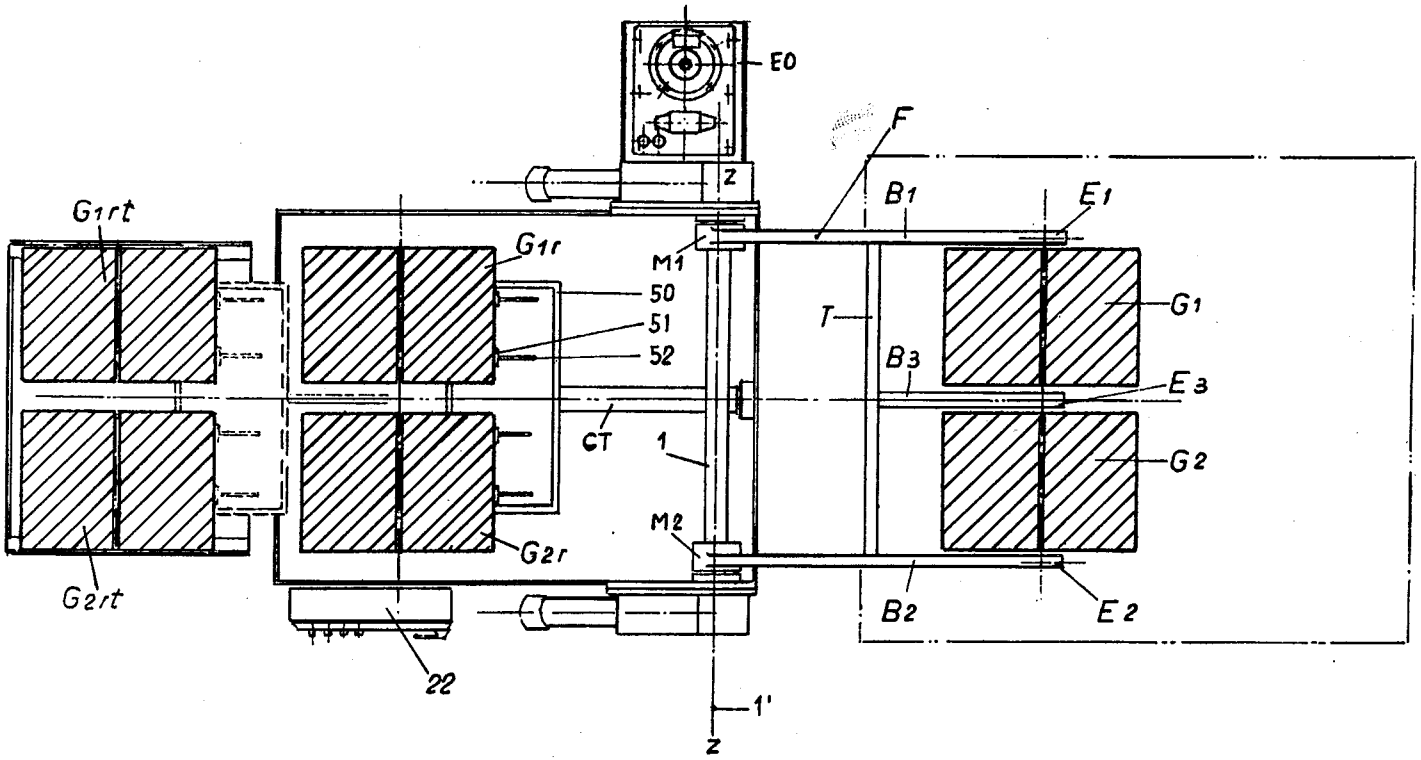
FIG. 2 is a schematic view of the machine in plan from above in illustrating the machine in its three basic positions.

IIIa position: once the feet of the bars linked to the pistons of the individual cylinders have taken hold on the base and on the lower sides of the shells in such a way as to grasp the latter firmly but without causing their breaking or damage the arm unit F is made to rotate through about 180 degrees backwards, that is anti-clockwise so that it arrives in the position indicated by the broken line and with the reference CO(III), which is in fact the intermediate position of the capsized shells G'1*r* and G2*r* (FIG. 2).

It can be seen in from FIG. 1 fact that the shells (comparable roughly to trapezoids) which had in the removal position PR(II) the larger bases at the bottom have now moved into the position CO(III) with these faces or lower bases pointing upwards, They have, that is, been overturned in the very action of their removal from the moulding machine. This is one of the most interesting and advantageous features of the invention which is characterized by an overturning maneuver by means of which one obtains simultaneously not only a considerable withdrawal from the source of moulding heat but also their turning over through 180 degrees. This latter part is essential because in the majority of cases the true foundry shell is obtained by combining in twos the semi-shells coming from the moulding machine. With the semi-shells already capsized thanks to the invention the coupling in twos will be extremely simple for the workman.

According to another advantageous aspect of the invention, when the capsized semi-shells have been carried into the delivery position CO (III) as in FIG. 1, corresponding to the positions of the semi-shells G1*r* and G2*r* in FIG. 2, automatically there is brought into action a transfer cylinder CT whose piston 48 carries at the end a transfer trolley/formed by bar 69, by the horizontal plate 50 and by the vertical thrust unit 51 supported by the bit 52. With the automatic activation of CT the piston 48 moves outwards and with it the thrust unit 51 which pushes the semi-shells G1 and G2 out of the plane of the station CO on which the frame T0 had placed them. The final position of the transfer trolley is indicated by 69', 48', 50' and 51'; in other words the stroke of the piston 48 and therefore of the thrust unit 51 is such that the semi-shells G1 and G2 pass directly on the track BL supported by the bit 60, which forms the plane of the final work position. Here the shells arrive therefore already capsized and fairly cold. They have in fact undergone a withdrawal from the position PR (II) in the forming machine which is equal to double of the horizontal projection of the rotation arm F or, better, is equal to the diameter of the semi-circumference SC define by the points of the shells from the ends 87 of the said semi-shells to which diameter must be added the transfer run of the piston 48.

For example in a particularly simple and effective embodiment the effective length of the arm is 1.20 m which means that with its backwards rotation of 180 degrees the shells undergo at first a withdrawal of 2.40 m to which must be added another movement of 0.80 m as a result of the transfer of the trolley CT.

Figure 7:
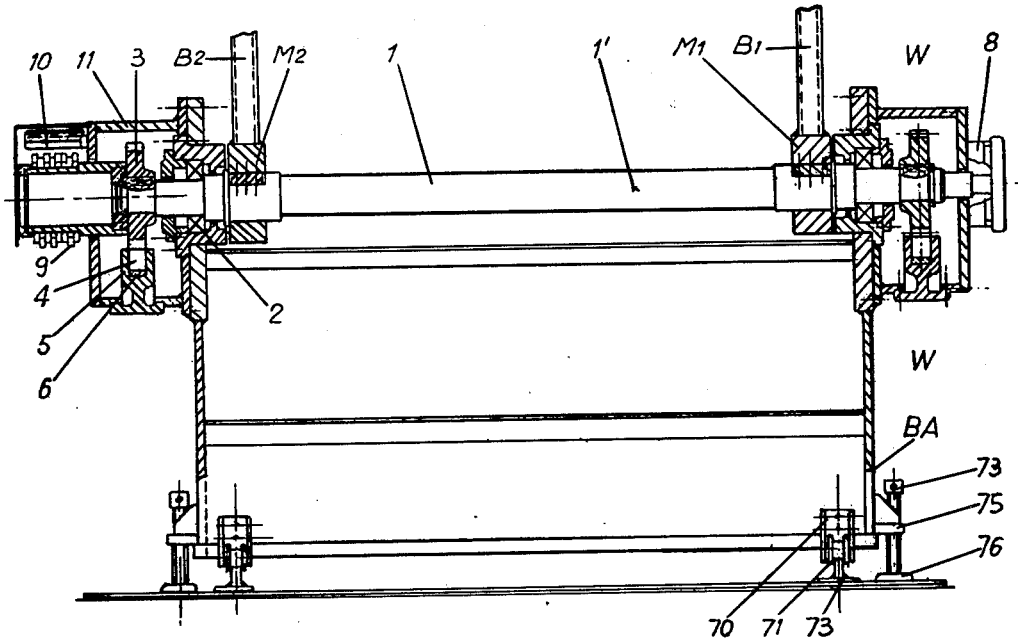
FIG. 7 is a schematic section of the activating device of the inverting arms, with a vertical plane containing the horizontal rotation axis of the shaft of the said arms with a plan having as trace the line Z—Z in FIG. 1.
Figure 8:
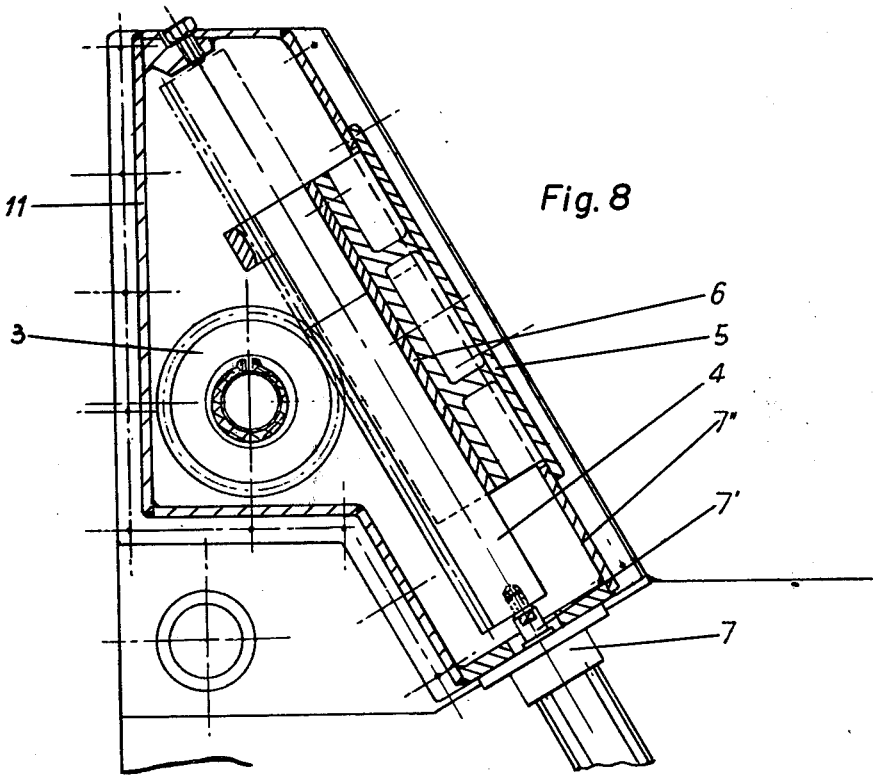
FIG. 8 is a section of the same device as in FIG. 7 but with a horizontal plane containing the axis of the rotation shaft and having as trace the line W—W in FIG. 7.

FIG. 7 represents the section of FIG. 1 with a plan tracing the line Z—Z while FIG. 8 is a schematic section of the above-mentioned FIG. 7 with a plan tracing the line W—W.

In these figures there is shown a preferable form of realisation for the inversion forwards and backwards of the arm unit F. The latter is mounted on shaft 1 on horizontal axis 1' by means of oscillating roller bearings, 2. On the two ends of the shaft 1 are mounted some toothed wheels 3 which mesh with two running rack and pinions 4. BA indicates the base of the machine.

The alternative movement of the rack and pinion determine the 180 degree rotation of the toothed wheels 3 and consequently of shaft 1 on the hubs M1 and M2 to which are fixed the arms B1 and B2.

The rack and pinions 4 run in two channels in cast iron (5) and are supported on two bronze shoes (6).

The movement of the rack and pinions is imparted by two hydraulic cylinders (7) whose bars 7' are connected, through the threaded end 7'', to the rack and pinions themselves.

In a preferred arrangement of the invention all of the above-mentioned mechanisms are enclosed in boxes of soldered steel (11), the hydraulic cylinders 7 have pistons of diameter 63 mm, the shaft of diameter 28 mm and the travel of 300 mm with shock absorption on both sides.

The shock absorption of cylinders 7 serves to slow down the rotation speed of the arm unit F in proximity to the lifting surface PR and to the support surface CO thus avoiding possible breakage of semi-shells that could come about if arm F were to have abrupt departure and arrival.

For the functioning of cylinders 7 use is made of an oleodynamic gearbox EO having for example the following characteristics: motor of 4 HP, gear pump with capacity of 16 lt/min. at maximum pressure of 70 kg/cm2, and a tank of 50 lt. (see FIG. 10).

During operation there is a maximum pressure of 40 kg/cm2 and therefore for the movements of the arm unit F 2494 kg are needed for the forward thrust and 2000 kg for the backward thrust.

At the end of shaft 1 are also fixed the following: on one side the electromagnetic brake (8) functioning on interruption of current to block the arm in the vertical position RCI and on the other side a series of cams (9) which in turning activate the various switches of the end of the run (10) for the various phases of the machine's functioning. These cams (9) and the various end of run switches (10) activated by them constitute the means of synchronisation between the pneumatic circuit elements and those of the hydraulic circuit.

From FIG. 1 and FIG. 7 it can be seen that in the ideal arrangement under the terms of the invention is fitted with four supports 70 located on the front and back walls of of base BA. To these supports 70 are fixed, by means of four pivots (not shown in the drawing) some wheels 71 which permit the whole complex of the machine to move, according to the longitudinal axis of the machine itself. As is shown in FIG. 7 this movement, which serves to position the machine exactly in accordance with the invention relative to the moulding machine, can be facilitated by the installation of two tracks 73 on which the wheels 71 run.

The supports 70 are fixed to the base BA with screws (not shown) passing through some slots made in the supports 70 themselves. These slots permit a further adjustment in height of the machine in accordance with the invention. Still on FIGS. 1 and 7, it can be seen that following the invention it is preferable to fit the machine with four contrasting screws 74 passing through threaded squares 76 fixed laterally to the base BA and carrying at the ends some shoes 75. Activating these screws 74 the shoes 75 are supported on the ground anchoring the machine to it and at the same time cutting out the wheels 71 avoid the slipping of the machine according to the invention when it is in position with the forming machine.

Figure 9:
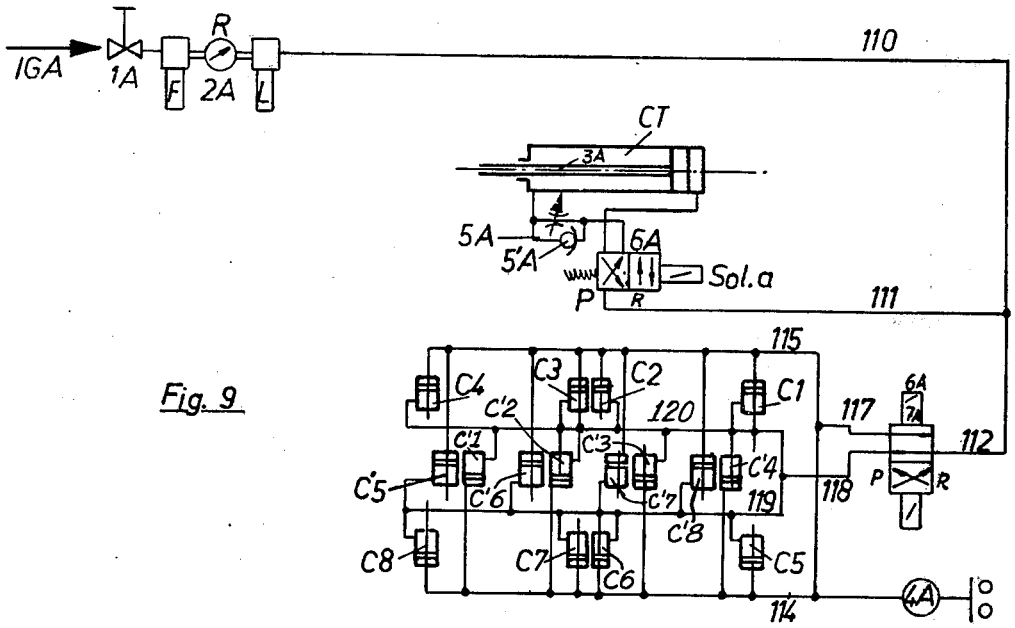
FIGS. 9 and 10 represent the pneumatic and oleodynamic circuits.

FIG. 9 shows the scheme of the pneumatic apparatus for the activation and control of the pneumatic cylinders linked to the means of lifting (16 cylinders on the invertable arm F) and to the means of transfer of the semi-shells (transfer cylinder CT); the pneumatic plant consists of the conduit IGA general inlet of compressed air followed by tap 1A, of group 2A including also filter f, of reducer r, of lubrificator L, of conduit 110 which supplies through conduit 111 the transfer cylinder CT of trolley 69 on one side and through conduit 112 the sixteen cylinders from C1 to C4, from C'1 to C'4, from C5 to C8 and from C'5 to C'8. The compressed air which arrives at the double effect pneumatic cylinder CT (which ideally has a diameter of 64 mm and a travel of 780 mm) passes through the flow regulator 5A which incorporates a non-return valve 5'A. The movements of piston 3A linked to cylinder CT are controlled by electrovalve 6A which is fitted with solenoid Sol.a, and therefore it passes air in direction P for the forward movement of piston 3A, or in direction R for the return of the said piston 3A from CT. Similarly air coming from 112 passes through electrovalve 6A and 7A (both 4/2 on a simple solenoid Sol.a) As can be seen from the plan the cylinders are supplied through conduits 117, 114, and 115 on one side and through conduits 118, 119, and 120 on the other. The conduit 114 is connected also to the delaying mechanism 4A.

Figure 10:
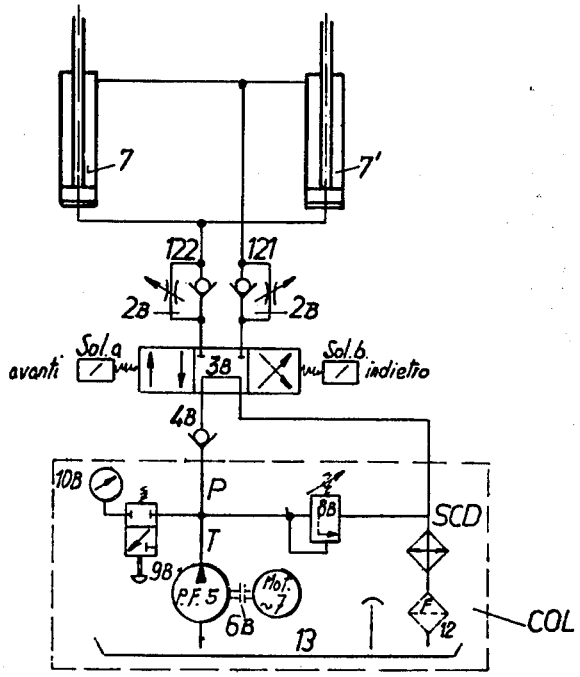

In FIG. 10 the oleodynamic apparatus of control of the arms B1 and B2 includes the oleodynamic gearbox EO consisting of a tank 13 having for example an oil capacity of 50 liters, of a pump with capacity P.F.5 drawn by a motor Mot. 7 through a drawing joint 6B; as stated before the pump PF5 has for example a capacity of 16 liters a minute with a maximum pressure of 70 atm. while the electric motor has 4 HP and a tension of from 220 to 380 V. The exit conduit T from the pump is connected in two directions: that on the left includes the gauge 10B and the valve 9B of insertion of the reading of said gauge; the right-hand connection includes on the other hand a valve 8B of excess pressure also connected to the heat exchanger SCD which in turn is connected to the oil filter F 12. The oil pumped by pump PF5 through P also passes through the non-return valve 4B and then to the electrovalve 3B (4/3 tandem with double solenoid Sol.a in front and Sol.b behind). Reference character 2B indicates the flow regulators with return valves incorporated, arranged on the supply conduits 121 and 122 which feed the two cylinders 7 and 7' which are either two separate hydraulic cylinders or one single double purpose hydraulic cylinder. As mentioned previously, in the ideal arrangement use should be made of one double purpose hydraulic cylinder with a travel of 300 mm cushioned on both sides and furnished with pistons having a diameter of 63 mm. and a stem of 28 mm. Acting on the flow regulators 2B it is possible to control as necessary the rotation speed of the arm unit F. Acting by means of the regulators 2B it is possible to obtain two rotation speeds of arm F for example a slow return when the arm carries the semi-shells G1 and G2 and a rapid movement outwards when the semi-shells are not being carried.

FUNCTIONING OR CYCLE OF THE MACHINE (1) At rest the fork or arm F is in the vertical position R (I) and in this vertical position it is restrained by the electromagnetic brake 8 which operates when there is no current. On a control panel 22 of the hydraulic circuit and the pneumatic circuit (the panel is not shown in the drawings) the operator in charge of the machine first pushes the starting button with which he frees the brake 8 and activates solenoid Sol.a in front of the electrovalve 3B of the oleodynamic circuit (FIG. 10). This solenoid causes the forward movement, that is the clockwise rotation in the direction of the arrow 200 of arm F leaving from the rest position R (I).

(2) The arm arrives in the position PR (II), horizontal and forwards and activates with one of the cams 9 one of switches 10 (not specifically shown) that: disconnects solenoid Sol.a ahead of the electrovalve 3B determining the stopping of arm F, activates solenoid Sol.a of the electrovalve 7A which activates the sixteen cylinders in closure grasping the semi-shells, from the bars, and brings into action the delay mechanism 4A which keeps the arm F in the horizontal position PR (II) a few seconds to be sure of the safe grasping of the shells in case of a fall of air pressure.

(3) When the above-mentioned few seconds have elapsed the delaying mechanism 4A operates activating the solenoid Sol.a of the electrovalve 3B which makes arm F move backwards (preferably at hugh speed).

(4) During its return movement the arm activates another of the many switches 9 (not specifically shown) which gives the go-ahead to the moulding machine 100 to begin another moulding cycle and another switch (not shown) which, when the arm is almost in a horizontal position behind CO (III), activates the solenoid Sol.b of the electrovalve 7A which activates the sixteen closing cylinders so as to release the shells.

(5) When the arm F arrives in a horizontal position behind CO (III) it again activates another switch 9 (not specifically shown) which disconnects solenoid Sol.b of the electrovalve 3B causing the stopping of arm F, and activates solenoid Sol.a of the electrovalve 6A which causes the forward departure of the transfer trolley CT pushing the shells outside the machine.

(6) The transfer trolley CT at the end of the movement 69' activates another switch (not specifically shown) which, disconnecting the solenoid Sol.a of the electrovalve 6A sends the transfer trolley CT back.

(7) At the end of its movement backwards 69 the transfer trolley activates another switch (not specifically shown) which activates the solenoid Sol.a of the electrovalve 3B and the arm F moves forward in a clockwise direction.

(8) The arm F reaches a vertical position R (I), activates the switch which disconnects the solenoid Sol.a of the electrovalve 3B causing the stopping of the arm and cuts off the current from the electromagnetic brake 8 which blocks the arm in the said position R (I).

The machine is ready for another cycle. The start should preferably by given by the operator re-pressing the starting button.

The invention has been described with reference to the outstanding features of the preferred arrangements as shown in the drawings; it is clear however that many variations modifications and substitutions can be effected without any effort on the part of the skilled in the art, regarding the basic elements of the realisation of the design represented. Since such modifications change neither the basic idea nor the structure of the machine they are to be considered as naturally falling within the wide scope and of the spirit of the invention.

I claim:

1. In a foundry including a molding machine for firing semi-shells in a hot area, a machine for extracting said semi-shells from said molding machine and for transferring said semi-shells to a work area remote from said hot area, said machine comprising:

(a) a pair of spaced apart arms, means for grasping said semi-shells, said grasping means comprising a pair of spaced apart opposed L-shaped member means, one on each arm, disposable on opposite sides of a semi-shell for engaging said semi-shell on two mutually perpendicular surfaces and means for moving said L-shaped member means toward and away from each other to respectively engage and disengage from the side faces and base of said semi-shell;

(b) means for pivotally moving said arms about a horizontal axis from said hot area to an intermediate area which is disposed diametrically from said hot area, whereby said semi-shells are overturned in said intermediate area; and (c) means for horizontally translatably moving said semi-shells from said intermediatea area to said work area more remote from than said hot area then is said intermediate area while maintaining said semi-shells in said overturned position.

2. The machine according to claim 1, further comprising a piston-cylinder means mounted on said arms and connected with said L-shaped member means for moving said L-shaped member means from the position of engagement with the semi-shells to that of disengagement.

3. The machine in accordance with claim 2, wherein said piston-cylinder means comprises a pair of pistons and cylinders, one on each arm for each L-shaped member means, said piston-cylinders being activated by compressed fluid.

4. The machine according to claim 1, said machine being capable of simultaneously extracting a pair of semi-shells from said molding machine, and further comprising a transverse member extending between said arms for stiffening same, and a central arm extending parallel to and in between said side arms, said central arm supporting an additional pair of L-shaped member means, one associated with one of said first pair of L-shaped member means for grasping a semi-shell therebetween.

5. The machine according to claim 4, wherein said central arm carries thereon twice as many means for moving said grasping means as do said side arms.

6. The machine according to claim 4, wherein said means for imparting horizontal transfer to said overturned semi-shells comprises an oscillating frame fixed to said side and central arms by means of threaded pivots, said central pivots regulating the height of said frame in order to adjust it for different thicknesses of semi-shells.

7. The machine in accordance with claim 1, wherein each of said arms comprises two angularly related parts, the part at the free end of the said arms assuming a position parallel to the formation plane of the semi-shells in the moulding apparatus when said grasping means are in position to grasp said semi-shells.

8. The machine in accordance with claim 1, wherein said means for pivotally moving said grasping means about said horizontal axis is a rack and pinion mechanism.

9. The machine in accordance with claim 1, wherein said means for horizontally transferrring said overturned semi-shells comprises a horizontally movable thrust trolley and an activating piston-cylinder connected thereto.

* * * * *